US005222263A

United States Patent [19]

Magistretti

[11] Patent Number: 5,222,263

[45] Date of Patent: Jun. 29, 1993

[54] UPHOLSTERED ELEMENT WITH CONTINUOUSLY UNIDIRECTIONALLY SHAPABLE FLAT INTERNAL FRAME

[75] Inventor: Vico Magistretti, Milan, Italy

[73] Assignee: Flou S.P.A., Meda, Italy

[21] Appl. No.: 856,534

[22] Filed: Mar. 24, 1992

[30] Foreign Application Priority Data

Apr. 10, 1991 [IT] Italy ..... 000310/91[U]

[51] Int. Cl.[5] ..... A47C 27/00

[52] U.S. Cl. ..... 5/465

[58] Field of Search ..... 5/465, 448, 648, 630, 5/420, 462, 464, 652; 297/391

[56] References Cited

U.S. PATENT DOCUMENTS 2,469,084 5/1949 Schenker ..... 5/465
3,140,897 7/1964 Dougherty ..... 5/465
4,420,186 12/1983 Vogt ..... 5/59.1

*Primary Examiner*—Alexander Grosz
*Attorney, Agent, or Firm*—Herbert Dubno; Yuri Kateshov

[57] ABSTRACT

Upholstered element formed with an interior, particularly a cushion, mattress or similar includes a quadrangular, substantially flat structure having a plurality of flattened and coplanar bar-shaped members interconnected along their longitudinal sides by hinge members, the hinging members being rotatable in one direction only from the flat structure configuration characterized by opposite faces of a plurality of the members lying in respective coplanar planes.

5 Claims, 1 Drawing Sheet

UPHOLSTERED ELEMENT WITH CONTINUOUSLY UNIDIRECTIONALLY SHAPABLE FLAT INTERNAL FRAME

FIELD OF THE INVENTION

The present invention relates to an upholstered element such as a cushion, mattress or similar, used as a backrest provided with an internal structure having unidirectionally orientable members capable of imparting to the cushion different shapes or a stable plane surface according to the requirements for use.

BACKGROUND OF THE INVENTION

As is known, upholstered cushions in general, and those with fillings of wool, down, and expanded synthetic fiber flock in particular, used as backrests are suitable for numerous uses owing to the complete freedom of movement and adaptation which the filling permits within the containing cover. They consequently have the advantage of making a rigid or semi-rigid supporting plane, for example the backrest of a chair, sofa or armchair, soft and agreeable, and also of imparting uniformity to areas disposed at an angle to each other or situated at different levels, as a result of the type of filling which is free to move to compensate for various types of recesses and differences in level. However, they also have both practical and aesthetic disadvantages, since, after their deformation, they are not always able to return to the original extended and full shape, as a result of which they create disagreeable aesthetic effects and a situation of disorder which has to be remedied by intervening manually to redistribute the filling material within the cover.

In the case of backrests consisting of large and small mattresses, equally spaced stitchings are provided to keep the filling uniformly distributed within the cover as long as possible. Such stitchings effectively divide the mattresses into the same number of sections of small dimensions.

OBJECTS OF THE INVENTION

The object of the present invention is to provide a flexible upholstered element avoiding the disadvantages of the known structures.

Another object of the invention is to provide an upholstered cushion provided internally with a structure capable of ensuring the stability of the shape of the cushion in a direction perpendicular to that of folding or of deformation.

Still another object is to provide an upholstered element capable of forming a rigid frame for support on fixed planes which are discontinuous or also at different levels, without having a negative effect on the functionality and comfort of the cushion.

A further object is to provide an upholstered element of various dimensions designed in such a way as to be usable both as a normal cushion or mattress and as an upholstered covering element for reclining seats with leg rests, sun loungers and similar.

SUMMARY OF THE INVENTION

These objects are achieved, according to the present invention, by an upholstered element of the cushion, mattress or similar type, with a unidirectionally variable shape, the element comprising internally at least one quadrangular substantially flat structure including a plurality of flattened and coplanar bar-shaped elements interconnected along their longitudinal sides by hinge elements, the hinge elements being of the frontally inset type and shaped in such a way as to permit rotations of the various bar-shaped elements in one direction only from the flat structure configuration. Therefore the structure permits the production of different shapes, which are variable in relation to the requirements for the use of the cushion, or, conversely, the maintenance of a stable supporting plane.

More particularly, the flattened bar-shaped elements consist of identical metal box sections each of which has two opposite longitudinal edges rounded in the form of an arc of a circle with its centre in the axis of rotation and the opposite edges in the form of planes tangent to the rounded edges to allow each pair of adjacent bar-shaped elements relative rotate about the respective hinging axes only on the side of the structure which has the rounding in the form of an arc of a circle.

Additionally, the hinging elements consist of prismatic projections or stems emerging from each bar-shaped element inserted in corresponding prismatic notches formed in the opposite sides of the adjacent bar-shaped elements, the projections are hinged within the corresponding notches by means of pins with an axis of rotation parallel to the longitudinal axis of each bar-shaped element.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
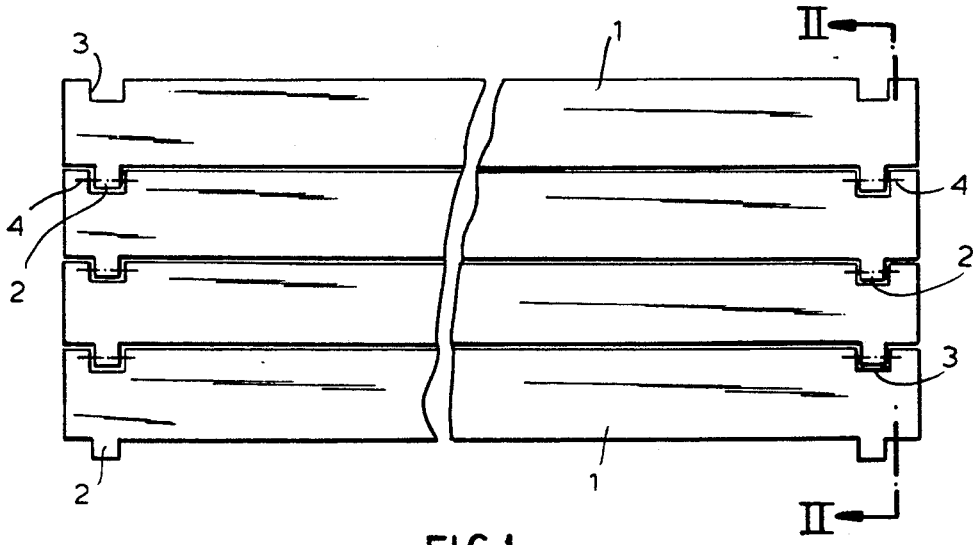
FIG. 1 is a front view of the structure of a reinforcing element according to the invention.

With reference to the figures, the structure of variable shape to which the invention relates consists of a plurality of identical bar-shaped elements 1, having a flattened box form. Each element is substantially D-shaped in the form of a hollow body of rectangular section having two opposite longitudinal edges la and lb rounded with a radius of curvature carefully specified, for reasons which will be explained in greater detail subsequently, side faces 10 and 11 and opposite bridging sides 12 and 13.

Each bar-shaped element 1 is connected rotatably to those adjacent to it in a chain by hinging means 4 including pins 4' journaled in respective passages 4 with an axis parallel to the longitudinal axis of the elements, which are constructed in such a way as to permit the rotation of each element in one direction only with respect to those adjacent to it, while in the opposite direction the flat surfaces of the unrounded adjacent elements form a single plane in combination.

Figure 3:
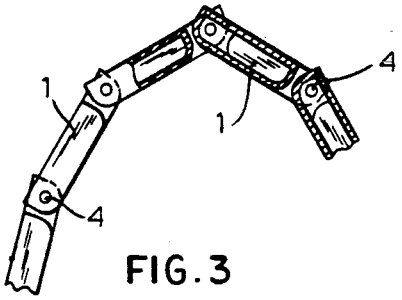
FIG. 3 is a sectional view analogous to the view of FIG. 2 partially curved.
Figure 4:
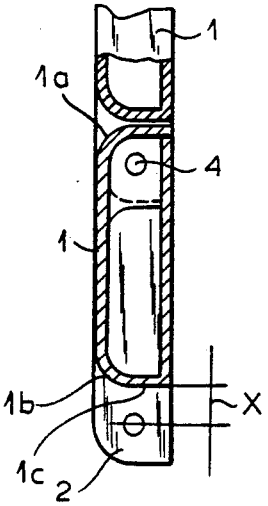
FIG. 4 is a transverse sectional view of a component of the structure in FIGS. 1 and 2.
Figure 5:
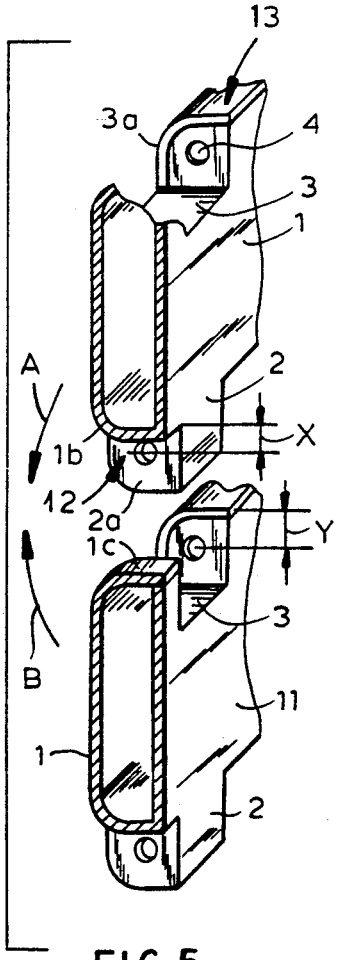
FIG. 5 is an axonometric view of two adjacent elements of the structure, brought together and ready to be hinged together.

More precisely, in order to provide this possibility, each element 1 has for example two projections or stems 2 (FIGS. 1, 4 and 5) emerging so, that they are coplanar with the respective sides 10 and 11 of the flattened bodies 1 with respect to a longitudinal side 1c of each body. The stems are of quadrangular prismatic form, designed in such a way that they may be housed within quadrangular notches 3 formed in the longitudinal faces or sides 13 of the adjacent elements 1. Each box-section element 1 therefore has at least one stem 2 on one face and a corresponding notch 3 on the opposite face. The rotatable connection between each stem and the corresponding notch is formed by means of pins inserted in transverse holes 4 formed coaxially in each side flanking the respective notch and the corresponding projection. The pins 4' are therefore axially aligned and parallel to the longitudinal axis of the elements coupled together Additionally, the coupling is formed in such a way that the elements 1, when kept coplanar in the rest position of the cushion as illustrated in FIG. 1, have their smaller flat faces 1c virtually in contact with each other, as a result of which any relative rotation between the elements 1 in the direction opposite that of the rounding is prevented. In order to permit, according to the invention, rotation only in the direction opposed to that of the coplanar position, for example the relative rotation between two elements in the direction of the arrows A–B in FIG. 5, each element 1 has its opposite edges 1a and 1b rounded, as are the edges 2a of the stems 2 and the edges 3a of the notches 3. Additionally, the distance "X" between the axis of rotation of each pin 4 and the side of the element 1 is made slightly greater than the distance "Y" between the axis of rotation and the side of the adjacent element. The roundings with their centers lying on the axis of rotation therefore enable each stem 2 to rotate within the corresponding notch 3, thus permitting the two bar-shaped elements to attain angles of up to approximately 90° with respect to each other, as shown in FIG. 3.

Figure 2:
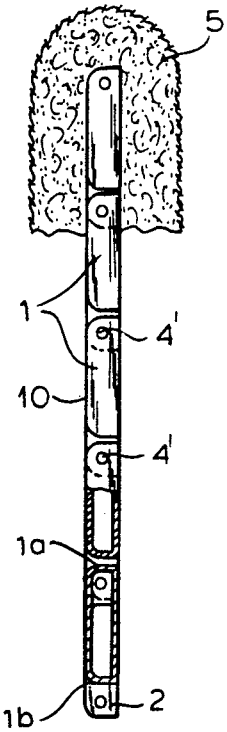
FIG. 2 is a transverse sectional view along the plane of line II—II of FIG. 1.

This structure with adjacent elements orientable in a single direction is to be inserted in a cushion or mattress 5 (FIG. 2), preferably in such a way as to keep the filling divided into two parts. With this disposition it is possible to make the cushion assume shapes having a form along the longitudinal axes of the bar-shaped elements 1 upon removing a weight of the user.

The upholstered cushion thus produced may therefore be used either as a normal supporting cushion on the seats of chairs, armchairs, sofas and similar, or also as a single cushion for backrests or for reclining chairs, and for coverings of armchairs with leg rests supported by the chairs, with the advantage, in all cases, of preventing undesirable irregular displacement of the filling within the cover.

Obviously, in the practical embodiment, the invention as described may be modified with respect to the materials used for the structure, the shape and dimensions of the cushion, and also the choice of the positioning of the structure with respect to the filling, without departing form the scope of protection of the invention.

I claim:

1. An upholstered element comprising:

a cushion;

a plurality of D-shaped links in said cushion, each of said links being formed with:

front and rear faces, and opposite sides bridging said faces and formed with respective surfaces, each of said surfaces being formed with a respective arcuate portion running into the front face and a respective generally flat portion laying at a right angle to the rear face; and hinge means for pivotally connecting said links together in a chain, the front and rear faces of said links being respectively coplanar and the respective flat portions of the surfaces of said opposite sides of the adjacent links being juxtaposed with one another in a rest position of said element, said chain deflecting from a coplanar position of said links upon receiving a load and returning to said rest position upon removing the load from said cushion.

2. The upholstered element defined in claim 1 wherein each of said links is formed with:

a respective projection formed on one of said sides, and a respective notch formed on the opposite side and receiving the projection of the adjacent link, the notch being formed with respective flanks, the hinge means including a passage formed in each of the projections and a pin extending along an axis and traversing the respective passage and being mounted on the respective flanks.

3. The upholstered element defined in claim 2 wherein each of said arcuate portions has a respective center lying on the axis of the respective pin.

4. The upholstered element defined in claim 2 wherein the projection is formed with a respective arcuate edge, so that said projection is able to rotate within the respective notch.

5. An upholstered element, comprising:

at least one reinforcing quadrangular substantially flat structure having a rest position and a loading position, said structure comprising a plurality of bar-shaped links, each of said links being formed with:

a respective box section, said box section being substantially rectangular transverse section and including:

front and rear faces extending along respective parallel longitudinal axes, opposite sides bridging front and rear faces and formed with respective longitudinal edges rounded in the form of an arc of a circle, each of said edges running into the front face, and a respective projection formed on one of said sides and provided with a respective longitudinal arcuate edge, at least one notch formed on the other of said opposite sides and provided with a respective pair of flanks each capped with the respective arcuate edge of the other side;

hinge means for pivotally connecting said links in a chain and including:

passages formed in each of said projections and the pair of flanks, so that the projection of one of the links is received in the notch of the adjacent link, the passages of the projection and the pair of flanks of the adjacent links being coaxial upon forming the chain, and a plurality of pins each traversing the coaxial passages of the adjacent links; and a cushion formed with an interior receiving said reinforcing structure, said front and rear faces of said box sections being respectively coplanar in the rest position, said chain deflecting rearwardly from said coplanar position of said faces of said links in said loading position with said projections rotatable in the respective notches upon receiving a load on said cushion.

* * * * *